US010815865B2

(12) United States Patent
Lee

(10) Patent No.: US 10,815,865 B2
(45) Date of Patent: Oct. 27, 2020

(54) COOLANT PUMP AND COOLING SYSTEM FOR VEHICLE

(71) Applicants: Hyundai Motor Company, Seoul (KR); Kia Motors Corporation, Seoul (KR)

(72) Inventor: Hyo Jo Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 240 days.

(21) Appl. No.: 16/175,258

(22) Filed: Oct. 30, 2018

(65) Prior Publication Data

US 2019/0301348 A1 Oct. 3, 2019

(30) Foreign Application Priority Data

Mar. 27, 2018 (KR) ..... 10-2018-0035152

(51) Int. Cl.
*F01P 5/12* (2006.01)
*F01P 3/02* (2006.01)
*F01P 7/14* (2006.01)

(52) U.S. Cl.
CPC *F01P 5/12* (2013.01); *F01P 3/02* (2013.01); *F01P 7/14* (2013.01); *F01P 2003/021* (2013.01); *F01P 2003/024* (2013.01); *F01P 2007/143* (2013.01); *F01P 2007/146* (2013.01); *F01P 2037/02* (2013.01)

(58) Field of Classification Search
CPC ..... F01P 5/12; F01P 3/02; F01P 7/14; F01P 2037/02; F01P 2003/021; F01P 2003/024; F01P 2007/146; F01P 2007/143; F01P 2060/04; F01P 2060/08; F01P 2060/16; F01P 2025/33; F01P 2025/31; F01P 7/16; F01P 2003/027; F04D 15/0038
See application file for complete search history.

(56) References Cited

U.S. PATENT DOCUMENTS

2006/0216166 A1* 9/2006 Pawellek ..... F01P 5/10 417/371
2011/0162597 A1* 7/2011 Draheim ..... F04D 15/0038 123/41.44
2012/0204818 A1* 8/2012 Welte ..... F04D 13/12 123/41.08
2012/0291724 A1* 11/2012 Popp ..... F04D 13/12 123/41.08
2013/0081583 A1* 4/2013 Weiss ..... F04D 15/0038 123/41.47
2014/0147304 A1* 5/2014 Weiss ..... F01P 5/12 417/364

(Continued)

*Primary Examiner* — Hung Q Nguyen
(74) *Attorney, Agent, or Firm* — Mintz Levin Cohn Ferris Glovsky and Popeo, P.C.; Peter F. Corless

(57) ABSTRACT

A coolant pump for a vehicle includes an impeller mounted at one side of a shaft and configured to pump a coolant, a pulley mounted at the other side of the shaft and configured to receive torque, a pump housing including an inlet into which the coolant inflows and an outlet of which the coolant flows out, a slider disposed to be movable in a longitudinal direction of the shaft so as to selectively block or open the outlet and a driver configured to move the slider, where a passage which supplies the coolant to at least one heat exchange element is formed on the pump housing.

19 Claims, 6 Drawing Sheets

(56) References Cited

U.S. PATENT DOCUMENTS

| | | | | |
|---|---|---|---|---|
| 2014/0212267 | A1* | 7/2014 | Pawellek | F04D 15/0022 415/26 |
| 2014/0308115 | A1* | 10/2014 | Popp | F01P 5/12 415/148 |
| 2016/0215679 | A1* | 7/2016 | Pawellek | F01P 5/12 |
| 2018/0172009 | A1* | 6/2018 | Hill | F01P 7/167 |

* cited by examiner

COOLANT PUMP AND COOLING SYSTEM FOR VEHICLE

CROSS-REFERENCE TO RELATED APPLICATION

This application claims under 35 U.S.C. § 119(a) the benefit of Korean Patent Application No. 10-2018-0035152 filed in the Korean Intellectual Property Office on Mar. 27, 2018, the entire contents of which are incorporated herein by reference.

BACKGROUND

(a) Technical Field

The present disclosure relates to a coolant pump, more particularly, to the coolant pump and a cooling system for a vehicle configured to improve a warm-up performance and a cooling performance by controlling a coolant flowing through a cylinder head and an engine block according to a driving condition and for realizing fail safe operation.

(b) Description of the Related Art

An engine discharges thermal energy while generating torque based on combustion of fuel, and a coolant absorbs thermal energy while circulating through the engine, a heater, and a radiator, and releases the thermal energy to the outside.

When a temperature of the coolant in the engine is low, viscosity of oil may increase to increase frictional force and fuel consumption, and a temperature of an exhaust gas may increase gradually to lengthen a time for a catalyst to be activated, which degrades quality of the exhaust gas. In addition, as a time required for a function of the heater to be normalized is increased, a driver may feel discomfort.

When the coolant temperature is excessively high, since knocking occurs, performance of the engine may deteriorate by adjusting ignition timing in order to suppress the knocking. In addition, when a temperature of lubricant is excessively high, a viscosity is lowered such that a lubrication performance may be deteriorated.

Therefore, a variable water pump for controlling several cooling elements so as to keep the coolant temperature high at a specific part of the engine and keep the coolant temperature low at other parts of the engine has been studied.

Generally, a variable water pump may stop flow of the coolant and control a flow rate of the coolant, and thus the variable water pump may improve a warm-up performance and enhance fuel efficiency.

However, when a heater, a low pressure (LP) exhaust gas recirculation (EGR) cooler and so on are operated in low temperature driving conditions or in relatively warm temperature driving conditions, coolant is supplied. In this case, warm-up timing is reduced and fuel efficiency is deteriorated.

The above information disclosed in this Background section is only for enhancement of understanding of the background of the disclosure and therefore it may contain information that does not form the prior art that is already known in this country to a person of ordinary skill in the art.

SUMMARY

The present disclosure provides a coolant pump and a cooling system for a vehicle having advantages of reducing warm up timing of an engine and for realizing fail safe function.

A coolant pump for a vehicle according to an exemplary embodiment of the present disclosure may include an impeller mounted at one side of a shaft and configured to pump a coolant, a pulley mounted at another side (i.e., the other/opposite side) of the shaft and configured to receive torque, a pump housing including an inlet into which the coolant inflows and an outlet of which the coolant flows out, a slider disposed to be movable in a longitudinal direction of the shaft so as to selectively block or open the outlet and a driver configured to move the slider, wherein a passage which continuously supplies the coolant to at least one heat exchange element is formed on the pump housing.

The slider may include a vertical portion formed perpendicular to the shaft and a block portion formed perpendicular to the vertical portion and selectively blocking the outlet, and a fail-safe hole which communicates with the outlet when the slider is completely closed may be formed in the block portion.

The driver may include a coolant delivery portion configured to deliver the coolant transmitted through the inlet, a control unit configured to exhaust the coolant transmitted from the coolant delivery portion to an outside or again transmitting the coolant to the coolant pump, a control chamber formed by the slider and the coolant pump housing and configured to move the slider according to the transmission of the coolant from the control unit and a position sensor configured to detect a position of the slider and output a corresponding signal.

The coolant pump may further include a return elastic portion provided between the slider and the impeller so as to elastically support the slider.

The control unit may include a check valve configured to prevent the coolant transmitted from the coolant delivery portion from being returned to the coolant delivery portion, a solenoid configured to open and close the check valve and a controller controlling an operation of the solenoid.

A cooling system for a vehicle according to an exemplary embodiment of the present disclosure may include a cylinder block, a cylinder head connected with the cylinder block, a plurality of heat exchange elements, a coolant pump for supplying a coolant to the cylinder block, to the cylinder head and to at least one heat exchange element of the plurality of heat exchange elements and a plurality of coolant lines connecting the cylinder block, the cylinder head, the plurality of heat exchange elements, and the coolant pump, wherein the coolant pump may include an impeller mounted at one side of a shaft and configured to pump a coolant, a pulley mounted at the other side of the shaft and configured to receive torque, a pump housing including an inlet into which the coolant inflows and an outlet of which the coolant flows out, a slider disposed to be movable in a longitudinal direction of the shaft so as to selectively block or open the outlet and a driver configured to move the slider, wherein a passage which continuously supplies the coolant to the at least one heat exchange element may be formed on the pump housing.

The slider may include a vertical portion formed perpendicular to the shaft and a block portion formed perpendicular to the vertical portion and selectively blocking the outlet, wherein a fail-safe hole which communicates with the outlet when the slider is completely closed may be formed in the block portion.

The driver may include a coolant delivery portion configured to deliver the coolant transmitted through the inlet, a control unit configured to exhaust the coolant transmitted from the coolant delivery portion to an outside or again transmitting the coolant to the coolant pump, a control chamber formed by the slider and the coolant pump housing and configured to move the slider according to the transmission of the coolant from the control unit and a position sensor configured to detect a position of the slider and output a corresponding signal.

The cooling system may further include a return elastic portion provided between the slider and the impeller so as to elastically support the slider.

The control unit may include a check valve configured to prevent the coolant transmitted from the coolant delivery portion from being returned to the coolant delivery portion, a solenoid configured to open and close the check valve and a controller controlling an operation of the solenoid.

The plurality of coolant lines may include a bypass coolant line which is connected with the passage and always supplies the coolant to the at least one heat exchange element.

The plurality of coolant lines may further include a block coolant line supplying coolant to the cylinder block, a head coolant line supplying coolant to the cylinder head, a radiator coolant line configured to supply the coolant to a radiator and assist coolant lines configured to supply the coolant to the plurality of heat exchange elements; wherein the cooling system may further include a coolant control valve which controls coolant flow to the block coolant line, the head coolant line, the radiator coolant line, and the assist coolant lines.

A cooling system for a vehicle according to an exemplary embodiment of the present disclosure may include a cylinder block, a cylinder head connected with the cylinder block, a plurality of heat exchange elements, a coolant pump for supplying a coolant to the cylinder block, to the cylinder head and to at least one heat exchange element of the plurality of heat exchange elements and a plurality of coolant lines connecting the cylinder block, the cylinder head, the plurality of heat exchange elements, and the coolant pump, wherein the coolant pump may include an impeller mounted at one side of a shaft and configured to pump a coolant, a pulley mounted at the other side of the shaft and configured to receive torque, a pump housing including an inlet into which the coolant inflows and an outlet of which the coolant flows out, a slider disposed to be movable in a longitudinal direction of the shaft so as to selectively block or open the outlet and of which a fail-safe hole which selectively communicates with the outlet is formed thereto and a driver configured to move the slider.

The slider may include a vertical portion formed perpendicular to the shaft and a block portion formed perpendicular to the vertical portion and selectively blocking the outlet, wherein the fail-safe hole communicating with the outlet when the slider is completely closed may be formed in the block portion.

The driver may include a coolant delivery portion configured to deliver the coolant transmitted through the inlet, a control unit configured to exhaust the coolant transmitted from the coolant delivery portion to an outside or again transmitting the coolant to the coolant pump, a control chamber formed by the slider and the coolant pump housing and configured to move the slider according to the transmission of the coolant from the control unit and a position sensor configured to detect a position of the slider and output a corresponding signal.

The cooling system may further include a return elastic portion provided between the slider and the impeller so as to elastically support the slider.

The control unit may include a check valve configured to prevent the coolant transmitted from the coolant delivery portion from being returned to the coolant delivery portion, a solenoid configured to open and close the check valve and a controller controlling an operation of the solenoid.

The cooling system may further include a block coolant temperature sensor configured to detect a temperature of coolant within the cylinder block and output a corresponding signal and a head coolant temperature sensor configured to detect a temperature of coolant within the cylinder head and output a corresponding signal, wherein the controller may determine whether a predetermined fail-safe operation condition is satisfied according to the signals of the position sensor, the block coolant temperature sensor and the head coolant temperature sensor, and the controller may control operations of the solenoid for the slider to be completely closed when the fail-safe operation condition is satisfied.

A passage which continuously supplies the coolant to at least one heat exchange element of the plurality of heat exchange elements may be formed on the pump housing.

The coolant pump and the cooling system according to an exemplary embodiment of the present disclosure may reduce the warm-up time of the engine by blocking coolant to the cylinder block and cylinder head in cold or low temperature driving conditions.

Also, the coolant pump and the cooling system according to an exemplary embodiment of the present disclosure may realize fail-safe operation so that a vehicle may function even in abnormal conditions.

DETAILED DESCRIPTION OF THE EMBODIMENTS

Figure 1:
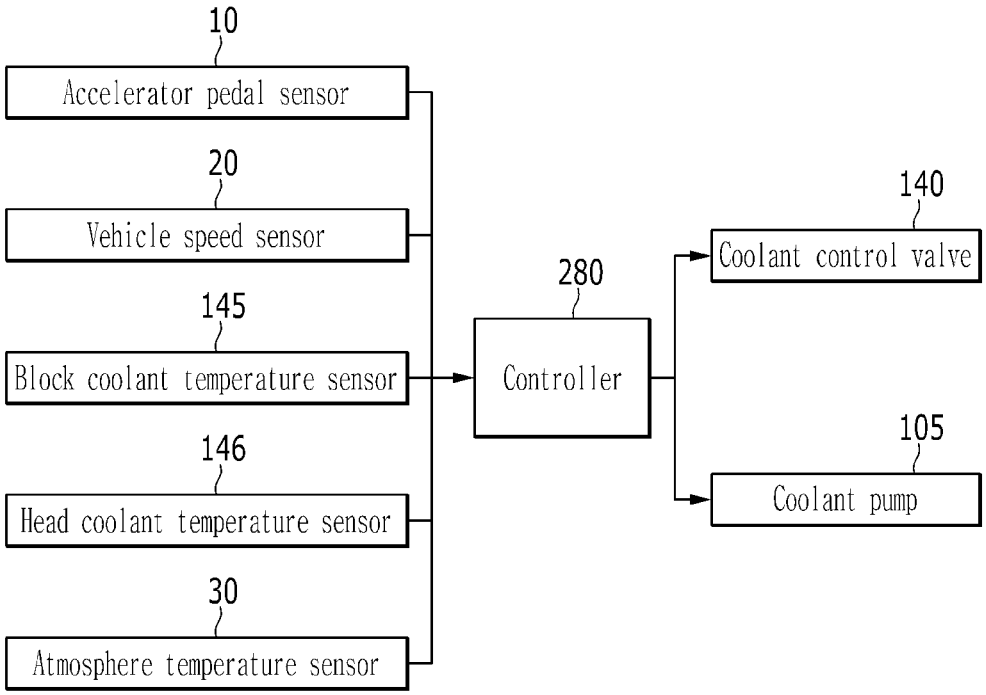
FIG. 1 is a block diagram of a cooling system including a coolant pump according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, exemplary embodiments of the present disclosure will be described with reference to the accompanying drawings.

The sizes and thicknesses of the configurations shown in the drawings are provided selectively for the convenience of description, such that the present disclosure is not limited to those shown in the drawings and the thicknesses are exaggerated to make some parts and regions clear.

However, parts irrelevant to the description will be omitted to clearly describe the exemplary embodiments of the present invention, and the same or similar constituent elements will be designated by the same reference numerals throughout the specification.

In the following description, names of constituent elements are classified as a first . . . , a second . . . , and the like so as to discriminate the constituent elements having the same name, and the names are not necessarily limited to the order.

Figure 2:
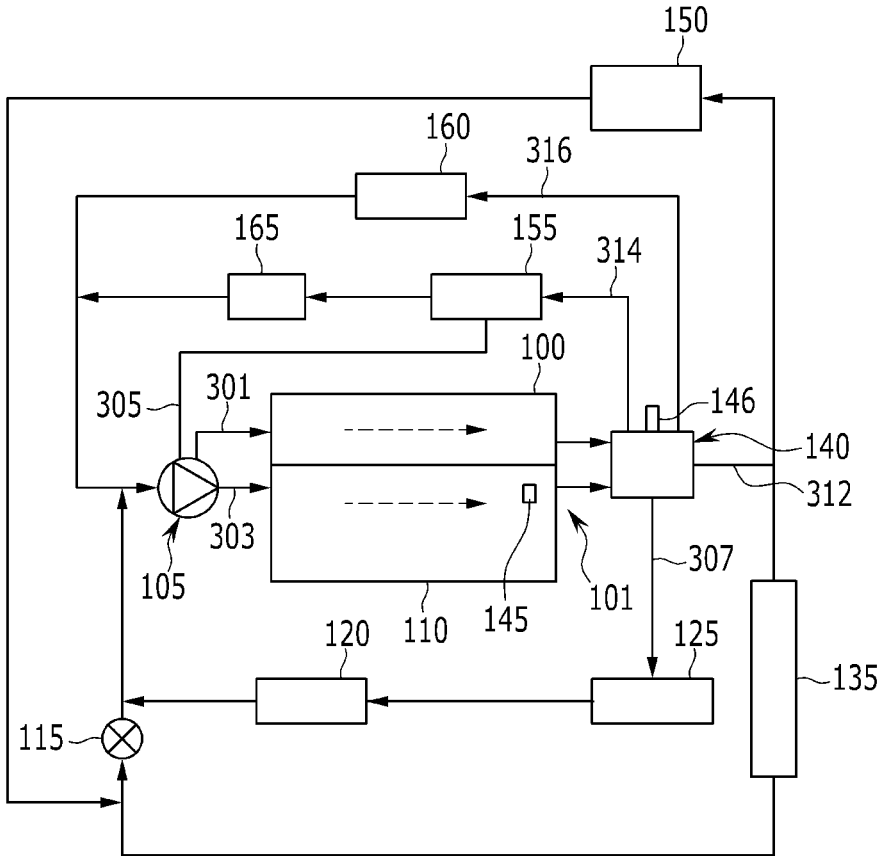
FIG. 2 is a schematic diagram of a cooling system including a coolant pump according to an exemplary embodiment of the present disclosure.

FIG. 1 is a block diagram of a cooling system including a coolant pump according to an exemplary embodiment of the present disclosure, and FIG. 2 is a schematic diagram of a cooling system including a coolant pump according to an exemplary embodiment of the present disclosure.

Referring to FIG. 1, a cooling system according to an exemplary embodiment of the present disclosure includes an engine 101 provided with a cylinder block 110 and a cylinder head 100 connected with the cylinder block 110, a coolant pump 105, a coolant control valve 140, and a plurality of heat exchange elements.

The coolant pump 105 is disposed near inlets of the cylinder block 110 and the cylinder head 100, and the coolant control valve 140 is disposed near outlets of the cylinder block 110 and the cylinder head 100.

The cooling system according to an exemplary embodiment of the present disclosure includes a vehicle operation state detecting portion, and a controller 280 controls operations of the coolant pump 105 and coolant control valve 140 according to output signals of the vehicle operation state detecting portion.

The controller 280 may be implemented as one or more microprocessors operating by a predetermined program, and the predetermined program may include a series of commands for performing the exemplary embodiment of the present disclosure.

The vehicle operation state detecting portion may include, for example, an accelerator pedal sensor 10, a vehicle speed sensor 20, a block coolant temperature sensor 145, a head coolant temperature sensor 146, an atmosphere temperature sensor 30 and so on.

The plurality of heat exchange elements may include, for example, a LP-EGR cooler 155, a heater 165, an EGR valve 160, a reservoir tank 150, a radiator 135, an oil cooler 125, an HP-EGR cooler 120, a thermostat 115 and so on.

A plurality of coolant lines is configured for connecting the cylinder block 110, the cylinder head 100, the plurality of heat exchange elements, and the coolant pump 105.

The coolant control valve 140 may control coolant flow from the cylinder block 110 and the cylinder head 100 and coolant flow to the plurality of heat exchange elements. Various mechanical or electrical devices which may control coolant flow may be applied to the coolant control valve 140.

The reservoir tank 150 is connected with a coolant line connected with the radiator 135, and coolant in the reservoir tank 150 is supplied to the coolant pump 105. The thermostat 115 is selectively opened according to coolant temperature. However, a position of the thermostat 115 is not limited as shown in the drawing, and optionally the thermostat 115 may not be required.

The block coolant temperature sensor 145 is configured for detecting a temperature of coolant within the cylinder block 110 and outputting a corresponding signal, and the head coolant temperature sensor 146 is configured for detecting a temperature of coolant within the cylinder head 146 and outputting a corresponding signal.

In the exemplary embodiment of the present disclosure, distribution of the coolant from the coolant control valve 140 to the plurality of heat exchange elements is not limited to that shown in the drawing. On the contrary, numerous variations may be available. Functions and schemes of the heat exchange elements, for example, the heater core, the radiator and so on would be apparent to a person skilled in the art, and thus detailed description will be omitted.

The coolant pump 105 receives coolant from the heat exchange elements and pumps.

The coolant pump 105 may supply the coolant to the cylinder head 100 or the cylinder block 110, or may supply the coolant to the cylinder head 100 and the cylinder block 110 simultaneously.

Figure 3:
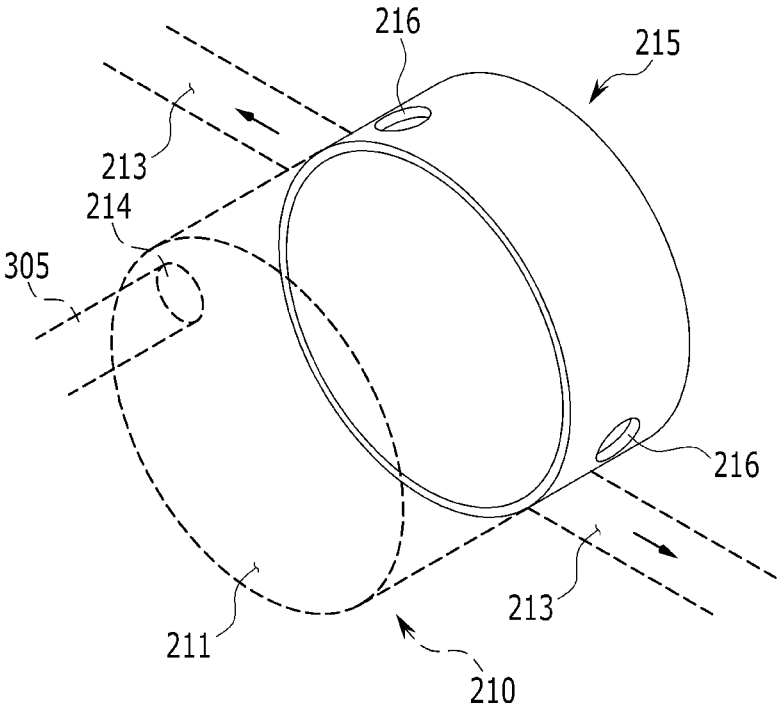
FIG. 3 is a perspective view of a slider of a coolant pump according to an exemplary embodiment of the present disclosure.
Figure 4:
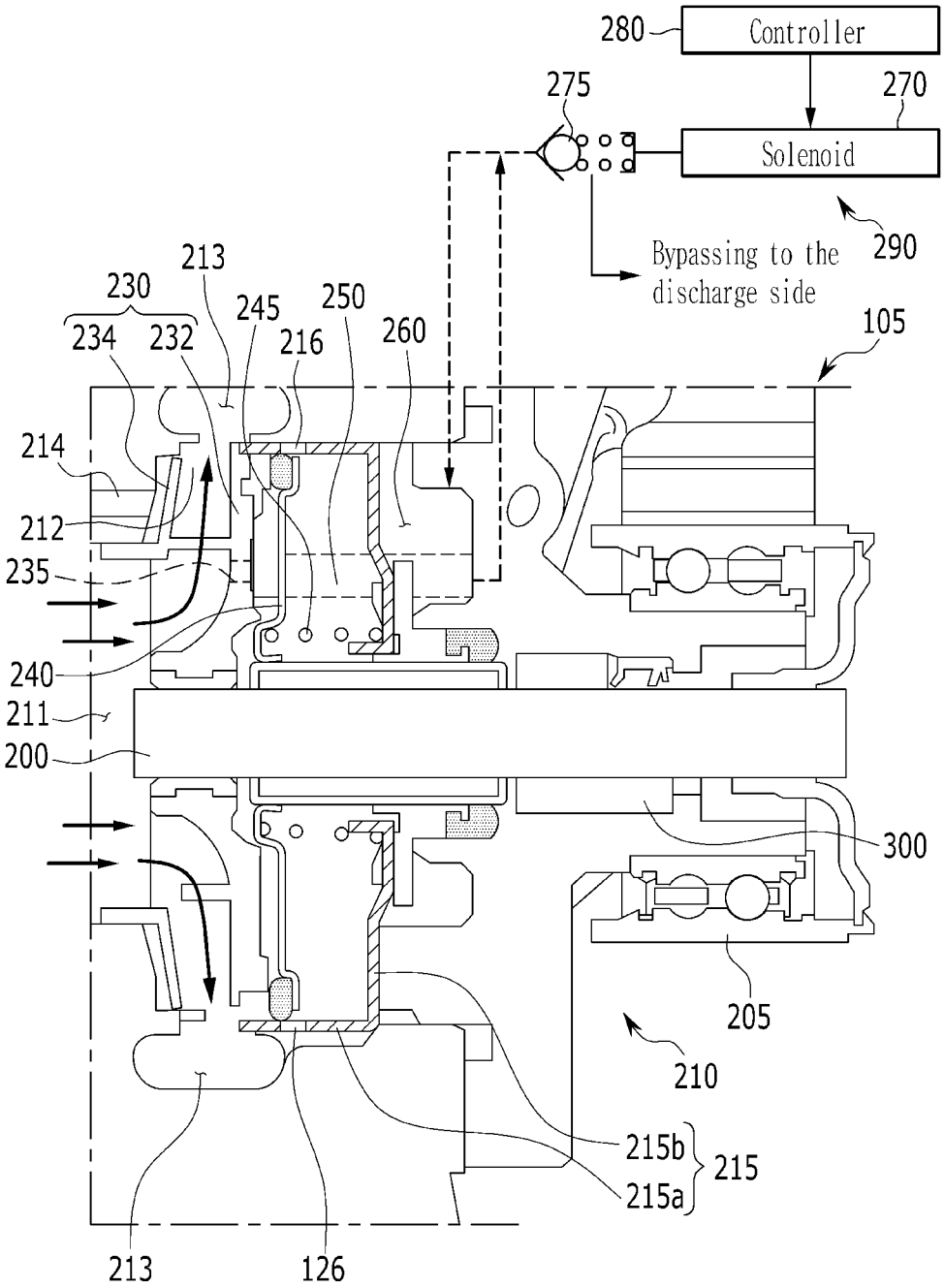
FIGS. 4 to 6 are cross-sectional views showing a coolant pump according to an exemplary embodiment of the present disclosure.
Figure 5:
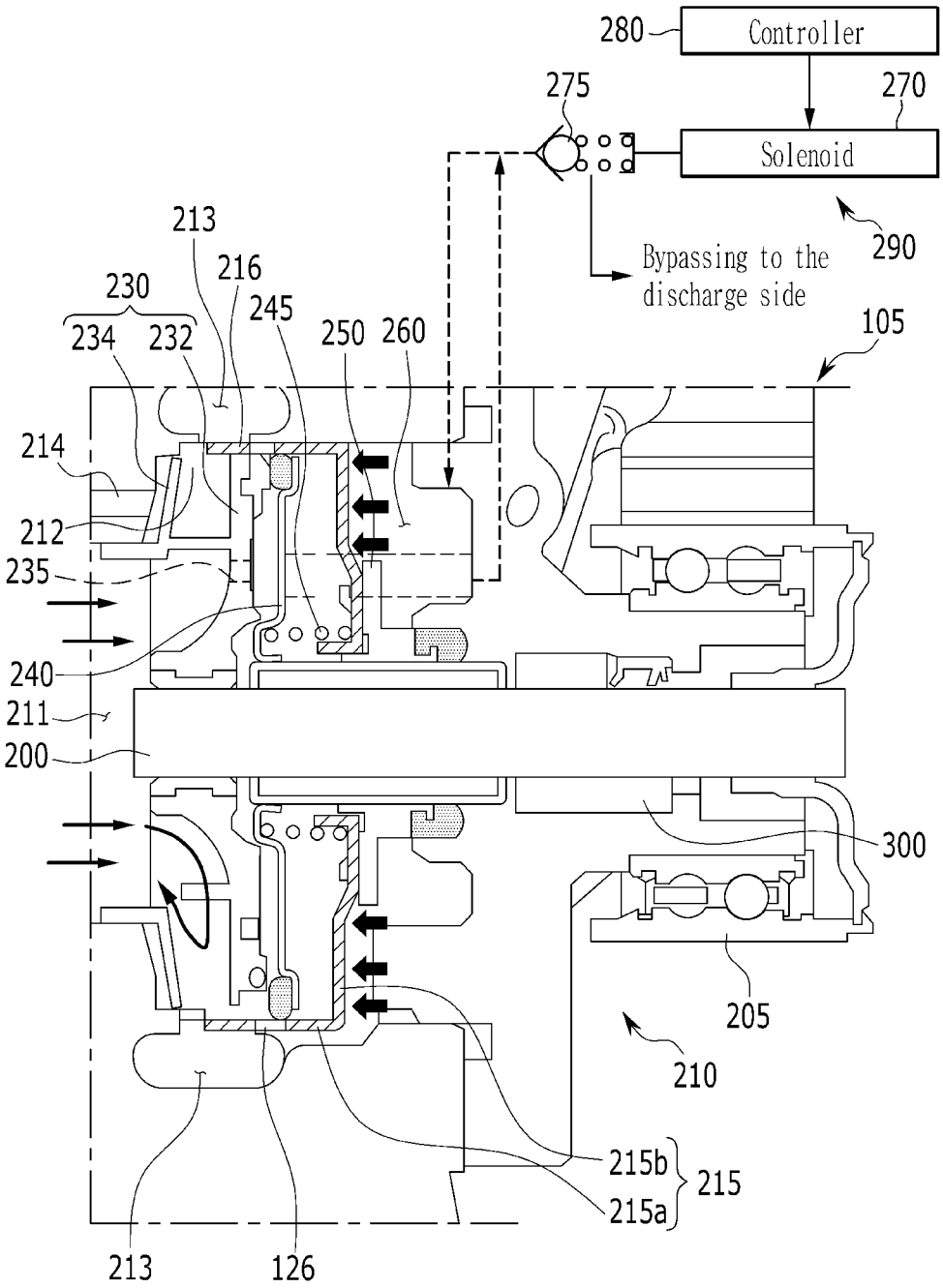
Figure 6:
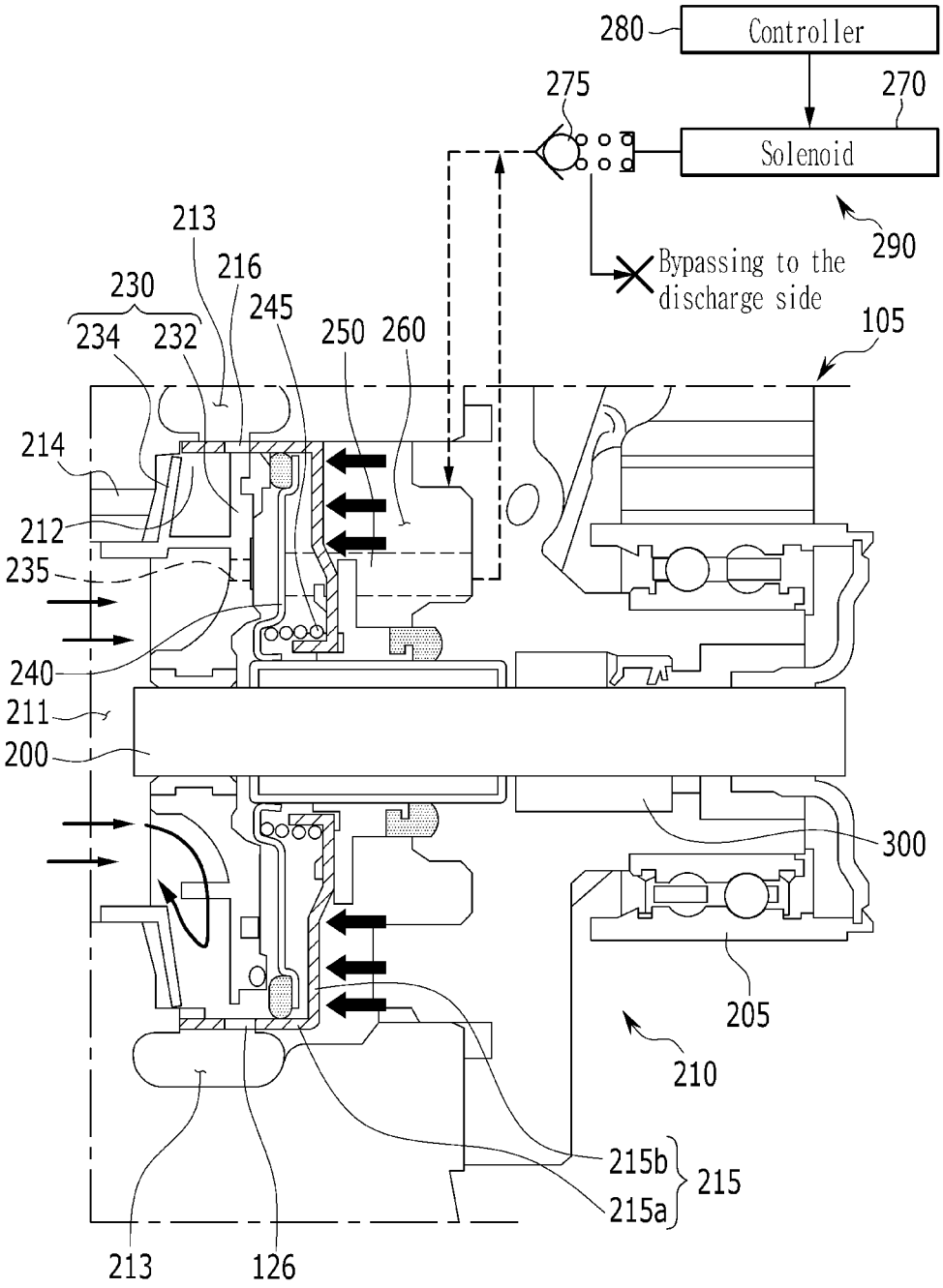

FIG. 3 is a perspective view of a slider of a coolant pump according to an exemplary embodiment of the present disclosure, and FIGS. 4 to 6 are cross-sectional views showing a coolant pump according to an exemplary embodiment of the present disclosure.

Referring to FIGS. 3-6, the coolant pump 105 according to an exemplary embodiment of the present disclosure includes an impeller 230 mounted at one side of a shaft 200 and configured to pump a coolant, a pulley 205 mounted at another side (i.e., the other side) of the shaft 200 and configured to receive torque, a pump housing 210 including an inlet 211 into which the coolant inflows and an outlet 213 of which the coolant flows out, a slider 215 disposed to be movable in a longitudinal direction of the shaft 200 so as to selectively block or open the outlet 213 and a driver configured to move the slider 215.

The outlet 213 is communicated with one of the cylinder block 110 and the cylinder head 100, or communicated with both the cylinder block 110 and the cylinder head 100. The outlet 213 supplies the coolant to the cylinder block 110 and/or the cylinder head 100 when the outlet 213 is opened.

The pulley 205 is mounted on one end of the shaft 200, and the pulley 205 receives a torque from an output shaft of the engine to rotate the shaft 200.

The impeller 230 is mounted on an external circumference of the shaft 200 and includes a rotation disk 232 of a disk shape and blades 234 formed at one surface of the rotation disk 232.

The driver includes a coolant delivery portion 250 transmitting the coolant transmitted through the inlet 211, a control unit 290 configured to exhaust the coolant transmitted from the coolant transmitting part 250 to the outside or again transmitting the coolant to the coolant pump 105, and a control chamber 260 formed by the slider 215 and the coolant pump housing 210 and configured to move the slider 215 depending on the transmission of the coolant from the control unit 290.

A position sensor 300 configured to detect a position of the slider 215 and output a corresponding signal is disposed within the pump housing 210.

A coolant delivery hole 235 may be formed at the coolant pump housing 210 to communicate with the inlet 211 and the coolant delivery portion 250.

A return elastic portion 245 is provided between the slider 215 and the impeller 230 to elastically support the slider 215, and a supporting member 240 may be provided between the slider 215 and the impeller 230 to support the return elastic portion 245.

The control unit 290 includes a check valve 275 configured to prevent the coolant transmitted from the coolant delivery portion 250 from being returned to the coolant delivery portion 250, a solenoid 270 configured to open and close the check valve 275, and a controller 280 controlling the operation of the solenoid 270.

The slider 215 includes a vertical portion 215*b* formed perpendicular to the shaft 200 and a block portion 215*a* formed perpendicular to the vertical portion 215*b* and selectively blocking the outlet 213.

A passage 214 which supplies the coolant to at least one heat exchange element is formed on the pump housing 210.

The passage 214 may be parallel to the shaft 200.

The plurality of coolant line includes a bypass coolant line 305 which is connected with the passage 214 and always supplies the coolant to the at least one heat exchange element.

The heat exchange element connected with the passage 214 may be the LP-EGR cooler 155 and/or the heater 165, and thus the coolant may be supplied continuously to the LP-EGR cooler 155 and/or the heater 165 regardless of driving conditions of a vehicle.

The plurality of coolant lines further includes a block coolant line 303 supplying coolant to the cylinder block 110, a head coolant line 301 supplying coolant to the cylinder head 100, a radiator coolant line 312 configured to supply coolant to the radiator 135, and assist coolant lines 307, 314 and 316 supplying coolant to the plurality of heat exchange elements.

The coolant control valve 140 controls coolant flow to the block coolant line 303, the head coolant line 301, the radiator coolant line 312, and the assist coolant lines 307, 314 and 316 according to control of the controller 280.

A fail-safe hole 216 communicating with the outlet 213 when the slider 215 is completely closed is formed in the block portion 215*a*.

Hereinafter, referring to FIGS. 1-6, operations of the coolant pump and the cooling system according to the exemplary embodiment of the present disclosure will be described.

In the state that the pulley 205 connected with a crankshaft is rotated, the part of the coolant transmitted to the inlet 211 is transmitted to the check valve 275 through the coolant delivery hole 235 and the coolant delivery portion 250.

The controller 280 determines an opening rate of the slider 215 based on signals of the vehicle operation state detecting portion including the accelerator pedal sensor 10, the vehicle speed sensor 20, the block coolant temperature sensor 145, the head coolant temperature sensor 146, and the atmosphere temperature sensor 30, and outputs the signal corresponding to the opening rate to the solenoid 270, thereby the check valve 275 is opened and closed depending on the operation of the solenoid 270.

If the check valve 275 is opened, the coolant transmitted through the coolant delivery portion 250 bypasses to the discharge side, the slider 215 moves backward by the elastic force of the return elastic portion 245, that is, moves to the right in the drawing, and the coolant is supplied the cylinder block 110 and/or the cylinder head 100 through the outlet 213.

If the check valve 275 is closed, the coolant transmitted through the coolant delivery portion 250 is transmitted to the control chamber 260, the slider 215 moves forward by the coolant pressure in the control chamber 260, that is, moves to the left in the drawing and closes the outlet 213.

The controller 280 may control operations of the solenoid 270 according to a position of the slider 215 through output signals of the position sensor 300.

The controller 280 controls for the outlet 213 to be closed if an output signal of the head coolant temperature sensor 146 satisfies a predetermined cold driving condition.

The predetermined cold driving condition may be preset as the output signal of the head coolant temperature sensor 146 is less than 50° C.

As shown in FIG. 5, in the cold driving condition the controller 280 controls for the block portion 215*a* to close the outlet 213, and thus the coolant does not flow into the block coolant line 303 and the head coolant line 301 so as that warm-up time of the engine 101 may be reduced. However, the coolant may flow through the passage 214 and the bypass coolant line 305, and thus the LP-EGR cooler 155 and/or the heater 165 may exchange heat with the coolant.

The controller 280 controls operations of the coolant pump 105 and the coolant control valve 140 if output signals of the block coolant temperature sensor 145 and the head coolant temperature sensor 146 satisfy a predetermined warm driving condition or a predetermined high temperature driving condition.

The predetermined warm driving condition may be preset as the output signal of the head coolant temperature sensor 146 is 50° C. to 90° C. and the predetermined high temperature driving condition may be preset as the output signal of the block coolant temperature sensor 145 higher than 90° C.

As shown in FIG. 4, the controller 280 controls the operation of the solenoid 270 to move the slider 215 to a predetermined position for adjusting opening amount of the outlet 213 and controls the operation of the coolant control valve 140 for the coolant to flow to the plurality of coolant lines.

In this case, the coolant may flow to the LP-EGR cooler 155 and/or the heater 165 through the bypass coolant line 305 and the assist coolant line 314 simultaneously.

Controlling positions of the slider 215 and flowing of the coolant of and coolant lines according to vehicle operation states are determined by experiments in advance, and detailed description will be omitted.

The controller 280 determines whether a predetermined fail-safe operation condition is satisfied according to output signals of the position sensor 300, the block coolant temperature sensor 145 and the head coolant temperature sensor 146, and controller 280 controls operations of the solenoid 270 for the slider 215 to moves if the fail-safe operation condition is satisfied.

For example, the controller 280 determines that the fail-safe operation condition is satisfied when the slider 215 is adhered.

When the fail-safe operation condition is satisfied, as shown in FIG. 6, the slider 215 moves to the completely closed position (to the left direction in the drawing) and moves to the completely opened position (to the right direction in the drawing) as shown in FIG. 4 repeatedly so as that the slider 215 may escape from the adhered state. In this case, as shown in FIG. 6, since the fail-safe hole 216 and the outlet 213 are communicated with each other, the coolant may flow continuously.

Also, the controller 280 may determine that the fail-safe operation condition is satisfied, for example, in abnormal operation of the coolant pump 105, malfunctions of the position sensor 300, and rapid changes of the coolant temperature and so on.

When the fail-safe operation condition is satisfied, the controller 280 may maintain state of closing the slider 215 completely as shown FIG. 6 so as that the fail-safe hole 216 and the outlet 213 are communicated for preventing the engine 101 from overheating.

While this disclosure has been described in connection with what is presently considered to be practical exemplary embodiments, it is to be understood that the disclosure is not limited to the disclosed embodiments. On the contrary, it is intended to cover various modifications and equivalent arrangements included within the spirit and scope of the appended claims.

What is claimed is:

1. A coolant pump for a vehicle, comprising:

an impeller mounted at one side of a shaft and configured to pump a coolant;

a pulley mounted at another side of the shaft and configured to receive torque;

a pump housing including an inlet into which the coolant inflows and an outlet of which the coolant flows out;

a slider disposed to be movable in a longitudinal direction of the shaft so as to selectively block or open the outlet; and a driver configured to move the slider, wherein a passage which continuously supplies the coolant to at least one heat exchange element is formed on the pump housing.

2. The coolant pump of claim 1, wherein the slider comprises:

a vertical portion formed perpendicular to the shaft; and a block portion formed perpendicular to the vertical portion and selectively blocking the outlet;

wherein a fail-safe hole which communicates with the outlet when the slider is completely closed is formed in the block portion.

3. The coolant pump of claim 2, wherein the driver comprises:

a coolant delivery portion configured to deliver the coolant transmitted through the inlet;

a control unit configured to exhaust the coolant transmitted from the coolant delivery portion to an outside or again transmitting the coolant to the coolant pump;

a control chamber formed by the slider and the coolant pump housing and configured to move the slider according to the transmission of the coolant from the control unit; and a position sensor configured to detect a position of the slider and output a corresponding signal.

4. The coolant pump of claim 3, further comprising a return elastic portion provided between the slider and the impeller so as to elastically support the slider.

5. The coolant pump of claim 3, wherein the control unit comprises:

a check valve configured to prevent the coolant transmitted from the coolant delivery portion from being returned to the coolant delivery portion;

a solenoid configured to open and close the check valve; and a controller controlling an operation of the solenoid.

6. A cooling system for a vehicle, comprising:

a cylinder block;

a cylinder head connected with the cylinder block;

a plurality of heat exchange elements;

a coolant pump for supplying a coolant to the cylinder block, to the cylinder head, and to at least one heat exchange element of the plurality of heat exchange elements; and a plurality of coolant lines connecting the cylinder block, the cylinder head, the plurality of heat exchange elements, and the coolant pump;

wherein the coolant pump comprises:

an impeller mounted at one side of a shaft and configured to pump a coolant;

a pulley mounted at another side of the shaft and configured to receive torque;

a pump housing including an inlet into which the coolant inflows and an outlet of which the coolant flows out;

a slider disposed to be movable in a longitudinal direction of the shaft so as to selectively block or open the outlet; and a driver configured to move the slider;

wherein a passage which continuously supplies the coolant to the at least one heat exchange element is formed on the pump housing.

7. The cooling system of claim 6, wherein the slider comprises:

a vertical portion formed perpendicular to the shaft; and a block portion formed perpendicular to the vertical portion and selectively blocking the outlet;

wherein a fail-safe hole which communicates with the outlet when the slider is completely closed is formed in the block portion.

8. The cooling system of claim 6, wherein the driver comprises:

a coolant delivery portion configured to deliver the coolant transmitted through the inlet;

a control unit configured to exhaust the coolant transmitted from the coolant delivery portion to an outside or again transmitting the coolant to the coolant pump;

a control chamber formed by the slider and the coolant pump housing and configured to move the slider according to the transmission of the coolant from the control unit; and a position sensor configured to detect a position of the slider and output a corresponding signal.

9. The cooling system of claim 8, further comprising a return elastic portion provided between the slider and the impeller so as to elastically support the slider.

10. The cooling system of claim 8, wherein the control unit comprises:

a check valve configured to prevent the coolant transmitted from the coolant delivery portion from being returned to the coolant delivery portion;

a solenoid configured to open and close the check valve; and a controller controlling an operation of the solenoid.

11. The cooling system of claim 6, wherein the plurality of coolant lines comprises a bypass coolant line which is connected with the passage and always supplies the coolant to the at least one heat exchange element.

12. The cooling system of claim 11, wherein the plurality of coolant lines further comprises:

a block coolant line supplying coolant to the cylinder block;

a head coolant line supplying coolant to the cylinder head;

a radiator coolant line configured to supply the coolant to a radiator; and assist coolant lines configured to supply the coolant to the plurality of heat exchange elements;

wherein the cooling system further comprises a coolant control valve which controls coolant flow to the block coolant line, the head coolant line, the radiator coolant line and the assist coolant lines.

13. A cooling system for a vehicle, comprising:

a cylinder block;

a cylinder head connected with the cylinder block;

a plurality of heat exchange elements;

a coolant pump for supplying a coolant to the cylinder block, to the cylinder head, and to at least one heat exchange element of the plurality of heat exchange elements; and a plurality of coolant lines connecting the cylinder block, the cylinder head, the plurality of heat exchange elements, and the coolant pump;

wherein the coolant pump comprises:

an impeller mounted at one side of a shaft and configured to pump a coolant;

a pulley mounted at the other side of the shaft and configured to receive torque;

a pump housing including an inlet into which the coolant inflows and an outlet of which the coolant flows out;

a slider disposed to be movable in a longitudinal direction of the shaft so as to selectively block or open the outlet and of which a fail-safe hole which selectively communicates with the outlet is formed thereto; and a driver configured to move the slider.

14. The cooling system of claim 13, wherein the slider comprises:

a vertical portion formed perpendicular to the shaft; and a block portion formed perpendicular to the vertical portion and selectively blocking the outlet;

wherein the fail-safe hole communicating with the outlet when the slider is completely closed is formed in the block portion.

15. The cooling system of claim 13, wherein the driver comprises:

a coolant delivery portion configured to deliver the coolant transmitted through the inlet;

a control unit configured to exhaust the coolant transmitted from the coolant delivery portion to an outside or again transmitting the coolant to the coolant pump;

a control chamber formed by the slider and the coolant pump housing and configured to move the slider according to the transmission of the coolant from the control unit; and a position sensor configured to detect a position of the slider and output a corresponding signal.

16. The cooling system of claim 15, further comprising a return elastic portion provided between the slider and the impeller so as to elastically support the slider.

17. The cooling system of claim 15, wherein the control unit comprises:

a check valve configured to prevent the coolant transmitted from the coolant delivery portion from being returned to the coolant delivery portion;

a solenoid configured to open and close the check valve; and a controller controlling an operation of the solenoid.

18. The cooling system of claim 17, further comprising:

a block coolant temperature sensor configured to detect a temperature of coolant within the cylinder block and output a corresponding signal; and a head coolant temperature sensor configured to detect a temperature of coolant within the cylinder head and output a corresponding signal;

wherein the controller determines whether a predetermined fail-safe operation condition is satisfied according to the signals of the position sensor, the block coolant temperature sensor and the head coolant temperature sensor, and the controller controls operations of the solenoid for the slider to be completely closed when the fail-safe operation condition is satisfied.

19. The cooling system of claim 13, wherein a passage which continuously supplies the coolant to at least one heat exchange element of the plurality of heat exchange elements is formed on the pump housing.

* * * * *